United States Patent [19]

Smith-Johannsen

[11] Patent Number: 5,057,674

[45] Date of Patent: Oct. 15, 1991

[54] SELF LIMITING ELECTRIC HEATING ELEMENT AND METHOD FOR MAKING SUCH AN ELEMENT

[75] Inventor: Robert Smith-Johannsen, Borgheim, Norway

[73] Assignee: Smith-Johannsen Enterprises, Incline Village, Nev.

[21] Appl. No.: 555,424

[22] PCT Filed: Jan. 30, 1989

[86] PCT No.: PCT/NO89/00011

§ 371 Date: Aug. 8, 1990

§ 102(e) Date: Aug. 8, 1990

[87] PCT Pub. No.: WO89/07381

PCT Pub. Date: Aug. 10, 1989

[30] Foreign Application Priority Data

Feb. 2, 1988 [NO] Norway ..... 880529

[51] Int. Cl.[5] ..... H05B 3/10

[52] U.S. Cl. ..... 219/553; 219/504; 219/505; 338/22 R; 338/25

[58] Field of Search ..... 219/504, 505, 510, 511, 219/540, 553, 528, 548, 494; 338/22 R, 25, 105

[56] References Cited

U.S. PATENT DOCUMENTS

| | | | |
|---|---|---|---|
| 4,017,715 | 4/1977 | Whitney et al. | 219/553 |
| 4,177,376 | 12/1979 | Horsma et al. | 219/553 |
| 4,330,703 | 5/1982 | Horsma et al. | 219/553 |
| 4,334,148 | 6/1982 | Kampe | 219/553 |
| 4,429,216 | 1/1984 | Brigham | 219/528 |
| 4,543,474 | 9/1985 | Horsma et al. | 219/553 |
| 4,654,511 | 3/1987 | Horsma et al. | 219/548 |
| 4,689,475 | 8/1987 | Kleiner et al. | 219/553 |
| 4,800,253 | 1/1989 | Kleiner et al. | 219/553 |
| 4,801,784 | 1/1989 | Jensen et al. | 219/548 |

*Primary Examiner*—Bruce A. Reynolds
*Assistant Examiner*—Michael D. Switzer
*Attorney, Agent, or Firm*—Pennie & Edmonds

[57] ABSTRACT

This invention relates to a self-limiting electrical heating element comprising resistance components having a positive temperature coefficient and a zero temperature coefficient, arranged in a layered structure with two electrodes placed diagonally within or in contact with two ZTC layers separated by a PTC layer.

6 Claims, 2 Drawing Sheets

SELF LIMITING ELECTRIC HEATING ELEMENT AND METHOD FOR MAKING SUCH AN ELEMENT

FIELD OF THE INVENTION

This invention relates to a self limiting electric heating element including two outer semiconductive layers having zero temperature coefficient ("ZTC") separated from one another by a continuous positive temperature coefficient ("PTC") layer and energized by two parallel electrodes, one of which is in contact with one end of one of the ZTC layers and the other parallel electrode is in contact with the other ZTC layer at its end furthest removed.

BACKGROUND OF THE INVENTION

There are known several types of self limiting electrical heating elements having geometrical configurations similar to those preferred in the invention. Such heating elements are known from, e.g., German patent No. 2,543,314 and the corresponding U.S. Pat. Nos. 4,177,376, 4,330,703, 4,543,474, and 4,654,511.

The heating elements described in said German patent DE-C2-2 543 314 relate in particular to heat recoverable articles. These articles are mostly used for sealing purposes such as covers for electrical components and cable joints. The heat recoverable article is arranged to be placed around the component or joint to be sealed, whereupon the article is connected to a power supply. The compositions and combinations of layers constituting the article are chosen such that the article is heated to a defined temperature at which the article shrinks and seals the electrical components or cable joint.

Similar heating elements are also described in U.S. Pat. No. 4,017,715 and EP-A1-0 237 228. The requirements of the elements described in U.S. Pat. No. 4,017,715 are that at room temperature the resistance in the ZTC layer is greater than the resistance exerted in the PTC layer.

From U.S. Pat. No. 4,689,475 there are known electrical heater devices which comprise at least one metal electrode and a conductive polymer in contact therewith, wherein the metal surface which contacts the conductive polymer has a roughened or otherwise treated to improve its adhesion to the conductive polymer. The metal electrode is preferably an electrodeposited foil. The conductive polymer preferably exhibits PTC behavior. The electrodes of these devices cover the entire area of the heater and there is only one current direction, namely that leading the shortest way through the PTC layer, from one metal foil to the other. While the described devices are claimed to include self-limiting heaters, their characteristics are substantially different from those obtained with the invention.

One of the objects of the invention is to provide a self regulating heating device, a property of which is its relative insensitivity to large variations in voltage at or near the thermal control temperature.

The invention will be described primarily in terms of composite devices wherein one component exhibits a positive temperature coefficient of resistance (PTC) and the other component exhibits essentially zero coefficient of resistance (ZTC) behavior.

A problem inherent in prior art devices depending solely on the variation of resistivity with temperature, has been that certain performance characteristics of the device were not always obtainable. For example, it is most desirable to maintain a given power output within a narrow control temperature range, and this temperature range does not always coincide with the anomaly temperature where most polymers exhibit their $T_s$ (switching temperature) and which is closely associated with the melting point in the case of crystalline polymers.

A feature of the invention is therefore to establish the control temperature of the device further removed from its crystalline melting point, since experience has shown that the closer a PTC component operates to its melting point, the less stable it is.

SUMMARY OF THE INVENTION

These features are obtained in accordance with the invention by making the components of the layered structure such that at room temperature, the resistance in the PTC layer between the ZTC layers is very much less than the resistance in the combined ZTC layers, which in turn is very much less than the resistance in the PTC layer between the electrodes, and where at control temperature the resistance in the PTC layer between the parallel ZTC layers is equal to the resistance in the parallel ZTC layers, the geometry being such that at the control temperature where the resistances of the two components are equal, the heat generated per time and unit area (the watt densities) are also essentially equal.

Due to these relationships in the invention the PTC layer at room temperature acts as a short circuit between the parallel ZTC layers. But because of geometry the resistance between electrodes in the PTC layer is very high when voltage is at first applied and the ZTC layers alone develop heat. However as the temperature rises the resistivity in the PTC layer increases until the resistance between the ZTC layers is equal to that of the combined ZTC layers. Slightly above this temperature the two ZTC layers act as electrodes and heat is generated uniformally throughout the system, and any further rise in temperature anywhere in the area of the ZTC layers effectively reduces or shuts off the current. In this way the PTC component acts almost only as a control, and the ZTC components perform as the active heating elements.

Under controlling conditions, because the ZTC layers act as electrodes, heat is generated over the entire area,- even outside the current carrying electrodes.

Because the initial current is independent of the resistance in the PTC control layer, variations of as much as 2 to 5 times the room temperature original PTC resistance play almost no role. Therefore the initial power output is unchanged in spite of a considerable degree of instability in the PTC layer.

Furthermore the cutoff, or control temperature is only slightly by large variations in voltage. Since the heating function is carried out mainly by the ZTC layers these elements have almost no inrush.

Because the ZTC layers are the main source of heat, and the PTC layer acts as the control in a current direction normal to the ZTC layers, the characteristic 'hot line' effect of a pure PTC element is completely eliminated and the element generates even heat over the entire area, and the temperature is regulated almost regardless of heat loss variations.

Because the PTC component is equal in area to the parallel ZTC components the maximum watt density in the PTC occurs when the resistances are equal, and at any higher temperature the density decreases rapidly.

In this way the PTC component is never highly stressed which is conductive to a long and stable life.

A novel feature of the invention is the limit placed on watt density at the control temperature. In the prior art patents much is said about the resistance and the resistivity of the two active components, but nowhere is watt density at control temperature mentioned. That this was not recognized as a factor can be shown from the examples of the mentioned patents. These clearly illustrate that the only concern was to control the effective $T_s$ of the elements and that no consideration was given (in fact no recognition of the problem) to the critical effect of relative watt densities.

Furthermore, the test method described in the prior art patents cannot be used to evaluate all the examples shown, because it would give false indication of the performance to be expected under selfheating heating conditions. In the test method described, the heating element was energized with a small power input, for measuring the variation in resistance of the whole element, but the temperature was controlled by an outside source which therefore was not sensitive to heat generated separately in the two components. This was important because in many cases the area of the two components differed. Therefore in a selfheating mode, such an element with a relatively small PTC component, but having the same resistance as the ZTC component at the control temperature would experience overheating in the PTC layer, and this could easily result in failure.

The whole intent of the heating elements described in U.S. Pat. No. 4,017,715 is to provide a means for exceeding (if only temporary) the melting point of the PTC layer. On the other hand the construction of the elements described in some of the other prior art patents place no limits on the temperature experienced by the PTC layer due to watt density or voltage gradient effects.

Much has been written about the so-called 'hot-line' effect, where, due to the positive coefficient of resistance of a PTC element, the tendency is for heat to be unevenly generated along a line midway between the two electrodes. This is especially the case where higher watt densities are experienced, or especially where there is insufficient heat loss so that a portion of the PTC film overheats. Another result of the hot line effect is that the voltage gradient in the area of the hot line becomes very great, and failure may actually occur first because of a dielectric breakdown effect. At any rate, to promote stability, the voltage gradient at control temperature, when the resistances are equal, must also be equal and this is the result of equal geometry as well as 100% electrical and thermal contact.

The PTC portion of a series PTC-ZTC element cannot shut off the power of the whole element until its resistance equals and then exceeds the resistance of the ZTC portion at that temperature. The temperature that each component of the element attains is a function of the power density inherent in its individual operation, and if the power density in the PTC component is very high when shut down occurs, its local temperature can be very high. Polymeric PTC materials are notably unstable close to or above the melting point of the plastic, which in turn is associated with the $T_s$ temperature.

Therefore, it is a critical factor in the invention to make series PTC-ZTC elements where the PTC component performs its limiting effect at temperatures well below the melting point of the plastic, or somewhat below its $T_s$ temperature. To accomplish this it is therefore essential that the heat generation or the watt density of the PTC component must not exceed the watt density of the ZTC component at the control temperature.

If the same terminology is used as in the mentioned prior art patents, U.S. Pat. Nos. 4,177,376, 4,330,703, 4,543,474, and 4,654,511 are hereby incorporated by reference then the PTC component of type 3 or 4 would be preferred over the sharp cutoff depicted for types 1 and 2. With such a PTC component, and assuming the cut off of the series element to occur when R(PTC)=R(ZTC), then the cut off temperature may be regulated over a wide range, and well below the melting point of the plastic or its type 1 $T_s$. In fact, making use of non-crystalline polymers with sufficient coefficient of expansion, but with no real melting point, would be more desirable. Because of the inherent instability of the PTC compositions and especially near the melting point (i.e. $T_s$) of crystalline polymers it is therefore important to develop limiting temperatures well below the melting point of the polymer in PTC component, or to make use of a suitable non crystalline polymer. This is in contrast to the configurations developed by prior workers in the field where cutoff is desired as close as possible to the Ts of the matrix polymer.

The present invention is thus directed to the relationship between the watt densities at the cutoff temperature, i.e. where resistances of the two components are equal. The same principle holds, for example, for a series construction between parallel facing electrodes. Here, again, the PTC control layer is protected from excess voltage gradients and watt densities by the coextensive layers of the ZTC or NTC material.

BRIEF DESCRIPTION OF THE DRAWINGS

The above mentioned and other features and objects of the invention will clearly appear from the following detailed description of embodiments of the invention taken in conjunction with the drawings, where.

DETAILED DESCRIPTION OF THE PREFERRED EMBODIMENTS

Figure 1:
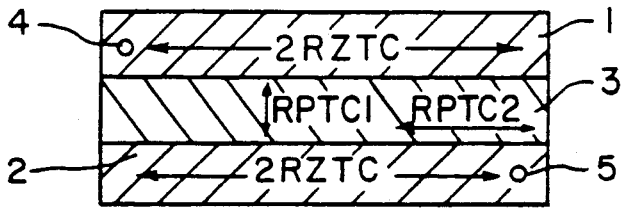
FIG. 1 shows a layered PTC-ZTC structure.

FIG. 1 schematically illustrates a structure having two ZTC layers 1 and 2 with a PTC layer 3 in between. The layers are in full contact with each other. Electrodes 4 and 5 are diagonally arranged in the ZTC layers, within the layers as shown or in contact with the layers as an alternative. 2RZTC is the resistance in each of the ZTC layers so that the resistance of both layers in parallel is RZTC. The resistance across the PTC layer is RPTC1 and the resistance along the PTC layer between the electrodes is RPTC2.

Figure 2:
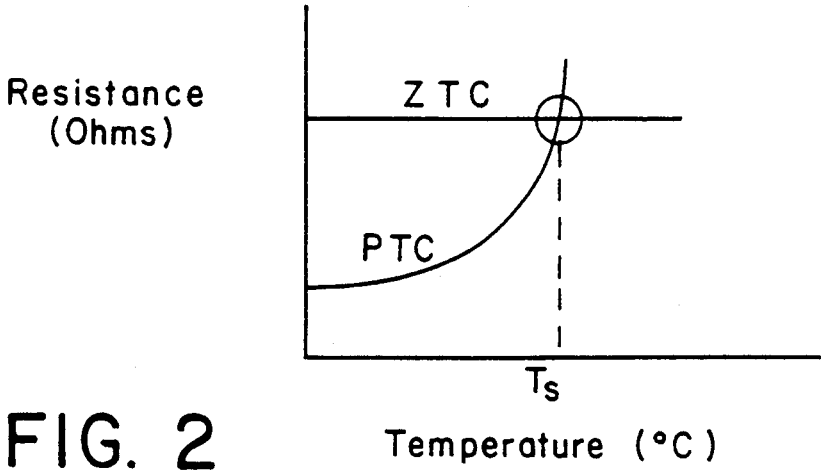
FIG. 2 is a resistance-temperature curve.

In FIG. 2 is illustrated a curve showing the relationship between the PTC resistance RPTC1 and the ZTC resistance as a function of temperature. At room temperature the resistance across the PTC in the electrode area must be very small compared to the resistance in the ZTC layers. Its function is to couple the parallel ZTC layers. At the same time the resistance in the PTC layer between the electrodes RPTC2, because of the ratio of thickness to width, must be substantially greater than the resistance in the ZTC layers, so that heat is generated almost only in the ZTC layers. At control temperature the resistivity in the PTC layer has risen so that its resistance between the ZTC layers equals the resistance in the ZTC layers themselves. Once the heating element has reached the control temperature the wattage output remains virtually unaffected despite substantial increases in voltage.

Another way of expressing the relationships between the resistances, and in more detail, is as follows:

The relationship between RPTC1 and RPTC2 is inherently taken care of by the geometry involving the ratio between the thickness of the PTC layer and the distance between the electrodes. The main requirement is that the resistances and thus power development at the control temperature are equal. Again, because of the 100% contact area of the PTC and ZTC components the watt density requirements are fulfilled.

The reason for the requirement that, at control temperature, the resistances in the PTC and ZTC components are equal, is that below this temperature, essentially all power is developed in the ZTC layers. When the resistance in the PTC layer exceeds the resistance in the ZTC layer, and because of the nature of the PTC resistance temperature curve, the heat will be generated predominantly in the PTC layer, but this also means that the resistance of the whole composite rapidly increases. In other words, at temperatures below the control temperature the characteristics, power output, stability etc are only a function of the ZTC component and the PTC provides only the limiting control.

The calculation of the relative values of resistance and resistivity in a given heating element can then go through the following procedure. In essence this is the same as that outlined above.

The effects of geometry on effective resistance in the PTC layer are as follows:

The resistance through the PTC layer is greatly dependant on the direction of current flow. For example, the resistance through the thickness of the PTC layer is very small compared to the resistance from electrode to electrode through the width of the layer. And furthermore the resistance across the PTC layer in the limited area of the electrodes must also be small compared to the resistance in the parallel ZTC layer.

Since $$RPTC2 = ohmcm \cdot d/(t.l)$$

and $$RPTC1 = ohmcm \cdot t/(d.l)$$

then $$RPTC1 = RPTC2 \cdot t^2/d^2$$

Depending on the ratio of distance between the electrodes (d) and the thickness of the PTC layer (t), the resistance in the vertical direction will at all times be $t^2/d^2$ times that in the horizontal direction.

Since at room temperature the ZTC resistance must be very much less than the RPTC2 and very much greater than the RPTC1, this sets limits on these resistance values in relation to the geometry of the device. But to be fully effective, at room temperature, the resistance through the PTC layer only in the area of the electrodes must also be so small compared to the ZTC resistance, that it acts as a coupling short circuit between the two ZTC layers, and then the watt density developed in this area is no greater than the watt density developed in the combined ZTC layers. Under these conditions the current will flow essentially straight across the PTC layer at each electrode, and then through the ZTC layers to the opposing electrodes. Now, as the temperature rises and the resistivity in the PTC layer increases, more and more of the PTC layer conducts current between the ZTC layers until a temperature is reached where the resistance offered by the PTC layer equals the resistance of the ZTC layers. Under these conditions equal heat is developed in both components. If the temperature rises still further, the PTC component in the series starts to limit the current passing through it and hence through the whole device. At this control temperature the current is flowing in effect half through the PTC and half through the ZTC and if the temperature increases further, due to for example an increased voltage, the resistivity in the PTC component continues to rise while the current flows more and more vertically through the PTC and less and less horizontally through the ZTC. This then surprisingly causes a compensating reduction in element resistance, which has the effect of maintaining a controlled wattage output over the whole control temperature range.

EXAMPLES

Figure 3:
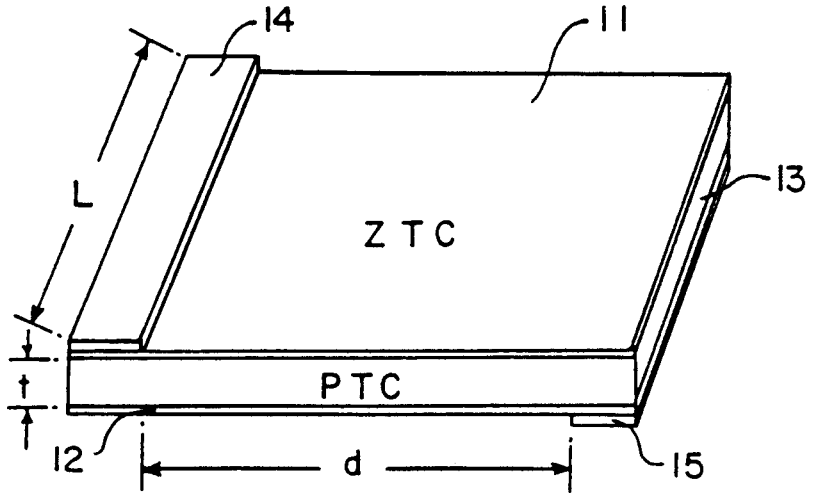
FIG. 3 shows an embodiment of a heating element.

The relationship between the geometry of the heating elements and the PTC and ZTC compositions used to make the elements will clearly appear from the following examples, with reference to FIG. 3 where two ZTC layers 11 and 12 are separated by a PTC layer 13. Electrodes 14 and 15 are connected diagonally to the ZTC layers. The PTC layer has a thickness t, a length l and a distance d between the electrodes 14, 15 which is equal to the length l, when the heater element is formed as a square.

In the squarely formed elements tested, the size of the elements varied from d=1.6 cm to d=45 cm. The thickness of the PTC layer varied from 0.05 to 0.1 cm, and the thickness of the combined ZTC layers from 0.0032 to 0.1 cm.

It is a requirement of the invention that at cutoff or control temperature:

$$RPTC1 = RZTC,$$

where RPTC1 is the electrical resistance measured across the PTC layer and where RZTC is the resistance of the two ZTC layers connected in parallel, each having a resistance of 2.RZTC.

Therefore, in an electrical square, since $$R = ohmcm \cdot (\text{distance between electrodes/area of electrodes}),$$

then $$RZTC = ohmcm(ZTC) \cdot d/(t(ZTC).d) = ohmcm(ZTC) \cdot 1/t(ZTC)$$

and $$RPTC1 = ohmcm(PTC) \cdot t(PTC)/d \cdot d$$

so that the ohmcm ratio $$\text{ohmcm(PTC)/ohmcm(ZTC)} = d^2/(t(\text{ZTC})\cdot t(\text{PTC}))$$

where t(ZTC) = the combined thickness of the two ZTC layers, and t(PTC) = the thickness of the PTC layer.

When the thickness of the PTC layer is 0.025 cm and the thickness of the combined ZTC layers are 0.0032 cm (using glass scrim impregnated layers), the ohmcm ratio values for the heaters are as follows, at control temperature (CT) and at room temperature (RT):

| d | CT | RT |
|---|---|---|
| 1.6 | 32,000 | 3,200 |
| 4.5 | 250,000 | 25,000 |
| 45 | $2.5 \cdot 10^7$ | $2.5 \cdot 10^6$ |

The corresponding ratios for heaters made with extruded ZTC layers of 0.025 cm thickness were:

| d | CT | RT |
|---|---|---|
| 1.6 | 2,048 | 204 |
| 4.5 | 16,200 | 1,620 |
| 45 | $1.6 \cdot 10^6$ | $1.6 \cdot 10^5$ |

A comparison with a prior art heating element (Beispiel 5) shows an ohmcm ratio of 20/7 = 2.85 at room temperature with a 2.54 times 2.54 size heating element, whereas one of the heating elements of the same size have an temperature. These ratios show the main difference between the prior art concepts and the concept of this invention.

An example of a heating device made in accordance with the invention and compared with a heating device made in accordance with the prior art as represented by DE Patent No. DE-02-2 543 314 and U.S. Pat. No. 4,017,715 are as follows:

The PTC layer consisted of 45 parts of ELETEX carbon in 100 parts of PE (polyethylene) or EVA (ethylene vinyl acetate) resin. The compound was made into a 0.1 cm thick film at a resistivity of $4 \cdot 10^4$ ohmcm at room temperature. The ZTC layers consisted of a glass scrim of an open structured glass paper, mat or cloth impregnated with an aqueous dispersion of KETCHEN BLACK. The Ketchen Black was run through a fluid energy machine along with 20% by weight of 40% colloidal silica (Dupont LUDOX HS-40). The fluid energy machine was utilized to modify the surfaces of the carbon particles by impinging the particles against one another in a high velocity gas stream. This material was dispersed in water along with 5% polyethyleneimine (PEI) to effectively wet the carbon black and control the charge on the carbon particles. The coating is modified with a binder consisting of an acrylic latex, clay and colloidal silica and also PEI, the binder being in a proportion to produce the desired resistance level on the coated scrim.

Thus with the PTC layer at a resistivity of $4 \cdot 10^4$ ohmcm and an ohm/square resistance of 400,000 combined with two ZTC layers of 3,000 ohm/square each (together in parallel 1,500 ohm/square) this device had at room temperature a resistance of 1,520 ohm where the area between the electrodes was 6.3·6.3 cm.

For comparison a sample was made according to the principles outlined in the prior art patents, the ohm/square resistance in the PTC layer was 1,600 and the ohm/square resistance in the combined ZTC layers was 15,000 ohms.

As will be seen from the above, the resistances of the components of the prior art device at room temperature, have the following characteristics:

$$RPTC1 << RPTC2 << RZTC,$$

which is quite different from the resistance relationships of the components according to the invention.

Figure 4:
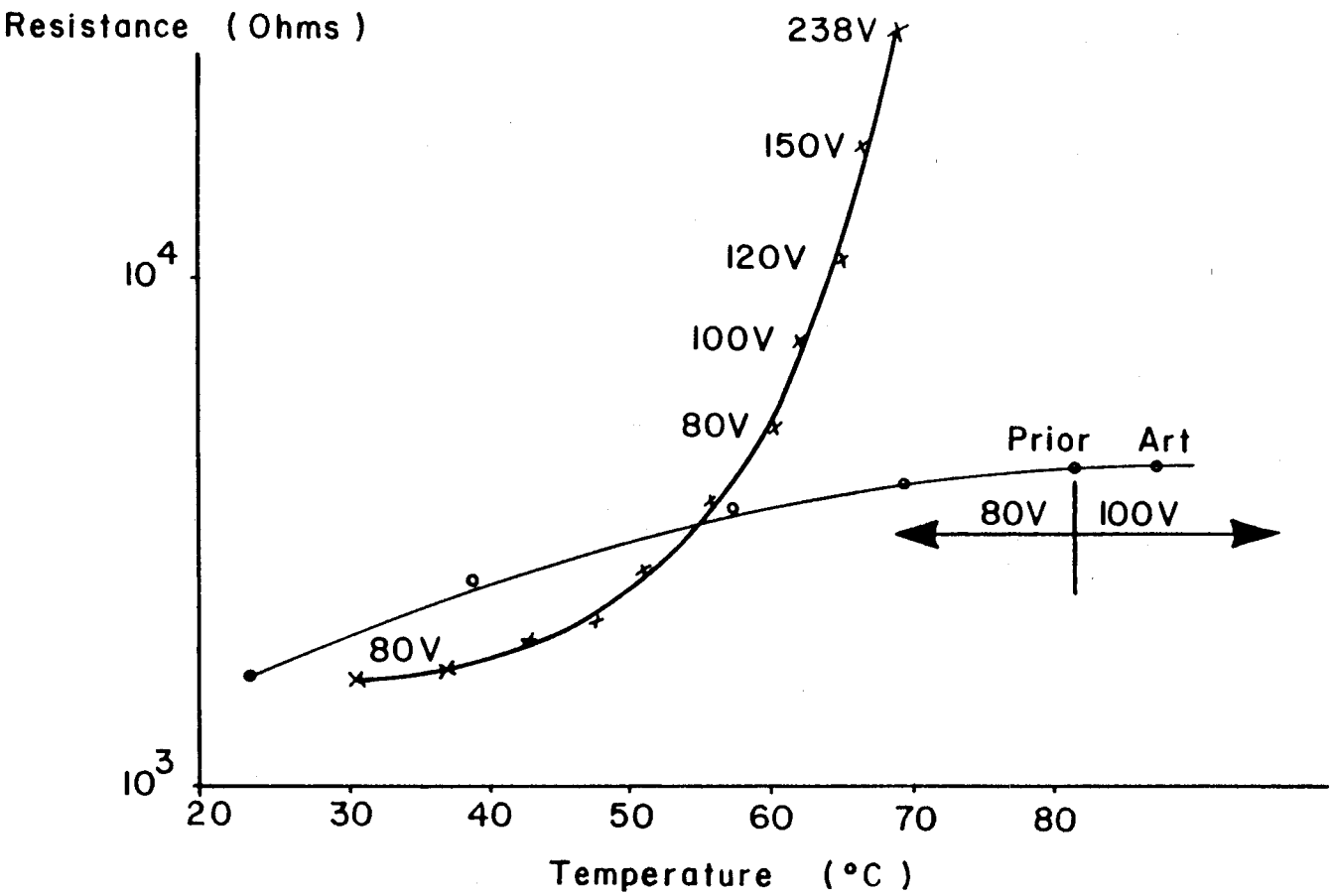
FIG. 4 illustrates the performance of the element according to the invention as compared to elements made according to the prior art technique.

The room temperature resistance of the two samples, before connecting them to a power supply, was comparable, but the performance, when connected to a power supply, was very different as can be seen from the curves illustrated in FIG. 4, especially with respect to the increasing voltage in the control temperature region.

I claim:

1. Self limiting electric heating element including two outer semiconductive layers (1, 2; 11, 12) having zero temperature coefficient (ZTC) separated from one another by a continuous positive temperature coefficient (PTC) layer (3; 13) and energized by two parallel electrodes (4, 5; 14, 15), one of which is in contact with one end of one of the ZTC layers and the other parallel electrode is in contact with the other ZTC layer at its end furthest removed from said one end, characterized in that the resistances of the PTC and ZTC components have the following characteristics: at room temperature:

$$RPTC1 << RZTC << RPTC2,$$

and at control temperature:

$$RPTC1 = RZTC,$$

where RPTC1 is the electrical resistance measured across the PTC layer, where RZTC is the resistance of the two ZTC layers connected in parallel, each having a resistance of 2·RZTC, where RPTC2 is the resistance measured between the electrodes (4, 5; 14, 15) along the PTC layer, so that at the control temperature the heat generated per time and unit area, i.e. the watt density, of the PTC layer and the watt density of the two parallel ZTC layers are essentially equal.

2. Heating element according to claim 1, characterized in that at control temperature in an element having sides d, 1, where l = d, a thickness t(PTC) of the PTC layer and a combined thickness t(ZTC) of the two ZTC layers, the ratio of resistivity of the PTC layer to that of the ZTC layers are: $d^2/(t(\text{PTC})\cdot t(\text{ZTC}))$.

3. Method of making a heating element according to claim 1 or 2, characterized in that the PTC layer (3; 13) is made from 20 to 50 parts of a large particle carbon black such as Elftex TM carbon in 100 parts of a thermoplastic resin such as PE or EVA and that the compound is made into a 0.025 to 0.2 cm thick film at a required resistivity.

4. Method of making a heating element according to claim 1 or 2, characterized in that the ZTC layers (1, 2; 11, 12) are made from a glass scrim impregnated with an aqueous dispersion of highly conductive carbon black, e.g. Ketchen Black TM.

5. Method according to claim 4, characterized in that the ZTC carbon black is run through a fluid energy machine along with 5 to 30% by weight of some 40% aqueous colloidal silica, e.g. DuPont Ludox HS-40 TM and that this composition is dispersed in water along with polyethyleneimine.

6. Method according to claim 5, characterized in that the ZTC carbon black mixture is modified with a binder consisting of an acrylic latex, clay and aqeous colloidal silica and also polythyleneimine, the binder being in a proportion to produce the desired resistance level on the coated scrim.

* * * * *